United States Patent [19]

Sharp

[11] 4,193,772

[45] Mar. 18, 1980

[54] PROCESS FOR CARBONACEOUS MATERIAL CONVERSION AND RECOVERY OF ALKALI METAL CATALYST CONSTITUENTS HELD BY ION EXCHANGE SITES IN CONVERSION RESIDUE

[75] Inventor: David W. Sharp, Seabrook, Tex.

[73] Assignee: Exxon Research & Engineering Co., Florham Park, N.J.

[21] Appl. No.: 912,610

[22] Filed: Jun. 5, 1978

[51] Int. Cl.[2] ..... C10J 3/06

[52] U.S. Cl. ..... 48/197 R; 48/202; 48/210; 208/9; 252/412; 423/181; 423/206 R

[58] Field of Search ..... 48/197 R, 202, 210; 252/373, 411, 412, 420, 413; 423/111, 119, 127, 203, 206 R, 208, 181; 208/10, 9; 201/38

[56] References Cited

U.S. PATENT DOCUMENTS

| | | | |
|---|---|---|---|
| 1,078,495 | 11/1913 | Gelleri | 423/203 |
| 3,033,647 | 5/1962 | Yamazaki | 423/203 |
| 3,948,791 | 4/1976 | Tominaga | 423/181 |
| 3,998,607 | 12/1976 | Wesselhoft | 48/197 R |

FOREIGN PATENT DOCUMENTS 108917 11/1957 U.S.S.R. .

OTHER PUBLICATIONS

"Rate of Decomposition of Nepheline by the Hydrochemical Method", Sazhim et al. Thermal Prikladnoi Khimia, vol. 39, No. 12, pp. 2617-2622, 12/1966.

"A Study of the Effects of Potassium on the Process of Decomposition of Aluminosiliates by the Hydrochemical Method", Bukhovets et al., Fiz KhimOSN, pp. 101-116, 1969.

*Primary Examiner*—S. Leon Bashore
*Assistant Examiner*—Peter F. Kratz
*Attorney, Agent, or Firm*—Yale S. Finkle

[57] ABSTRACT

In a coal gasification operation or similar conversion process carried out in the presence of an alkali metal-containing catalyst wherein solid particles containing alkali metal residues are produced, alkali metal constituents are recovered for the particles by contacting or washing them with an aqueous solution containing calcium or magnesium ions in an alkali metal recovery zone at a low temperature, preferably below about 249° F. During the washing or leaching process, the calcium or magnesium ions displace alkali metal ions held by ion exchange sites in the particles thereby liberating the ions and producing an aqueous effluent containing alkali metal constituents. The aqueous effluent from the alkali metal recovery zone is then recycled to the conversion process where the alkali metal constituents serve as at least a portion of the alkali metal constituents which comprise the alkali metal-containing catalyst.

11 Claims, 2 Drawing Figures

PERCENT RECOVERY OF TOTAL POTASSIUM
50
40
30
20
10
0
1
2
3
4
5
6
NUMBER OF WASHES
CALCIUM HYDROXIDE SOLUTION
DISTILLED WATER

PROCESS FOR CARBONACEOUS MATERIAL CONVERSION AND RECOVERY OF ALKALI METAL CATALYST CONSTITUENTS HELD BY ION EXCHANGE SITES IN CONVERSION RESIDUE

The government of the United States of America has rights in this invention pursuant to Contract No. E(49-18)-2369 awarded by the U.S. Energy Research and Development Administration.

BACKGROUND OF THE INVENTION

1. Field of the Invention

This invention relates to the conversion of coal and similar carbonaceous solids in the presence of alkali metal-containing catalysts and is particularly concerned with the recovery of alkali metal constituents from spent solids produced during coal gasification and similar operations and their reuse as constituents of the alkali metal-containing catalysts.

2. Description of the Prior Art

Potassium carbonate, cesium carbonate and other alkali metal compounds have been recognized as useful catalysts for the gasification of coal and similar carbonaceous solids. The use of such compounds in coal liquefaction, coal carbonization, coal combustion and related processes has been proposed. To secure the higher reaction rates made possible by the presence of the alkali metal compounds it has been suggested that bituminous coal, subbituminous coal, lignite, petroleum coke, oil shale, organic wastes and similar carbonaceous materials be mixed or impregnated with potassium, cesium, sodium or lithium compounds, alone or in combination with other metallic constituents, before such materials are reacted with steam, hydrogen, oxygen or other agents at elevated temperatures to produce gaseous and/or liquid products. Studies have shown that a wide variety of different alkali metal compositions can be used for this purpose, including both organic and inorganic salts, oxides, hydroxides and the like. In general the above-described studies indicate that cesium compounds are the most effective gasification catalysts followed by potassium, sodium and lithium compounds in that order. Because of the relatively high cost of cesium compounds, most of the experimental work performed in this area in the past has been directed toward the use of compounds of potassium and sodium. This work has shown that the potassium compounds are substantially more effective than the corresponding sodium compounds. Attention has therefore been focused on the use of potassium carbonate.

Coal gasification processes and similar operations carried out in the presence of alkali metal compounds at high temperatures generally result in the formation of chars and alkali metal residues. The chars normally include unconverted carbonaceous constituents of the coal or other feed material and various inorganic constituents generally referred to as ash. It is generally advisable to withdraw a portion of the char from the reaction zone during gasification and similar operations in order to eliminate the ash and prevent it from building up within the reaction zone or other vessels in the system. Elutriation methods and other techniques for separating char particles of relatively high ash content and returning particles of relatively low ash content to the reaction zone in order to improve the utilization of carbon in such processes have been suggested. In gasification and other processes referred to above that utilize alkali metal-containing catalysts, the cost of the alkali metal constituents is a significant factor in determining the overall cost of the process. In order to maintain catalyst cost at reasonable levels, it is essential that the alkali metal constituents be recovered and reused. There have been proposals for the recovery of alkali metal constituents by water leaching as they are withdrawn from the reaction zone with char during operations of the type referred to above. Studies indicate that these constituents are generally present in part as carbonates and other water-soluble compounds which can be at least partially recovered by water washing. Experience has shown that only a portion of the potassium carbonate or other alkali metal constituents is normally recovered and that substantial quantities of makeup alkali metal compounds are therefore required. This adds appreciably to the cost of such operations.

It has recently been found that increased amounts of water-soluble alkali metal constituents can be effectively recovered from the char particles by treating them with calcium hydroxide in the presence of water at elevated temperatures and pressures. The calcium ions from the calcium hydroxide evidently react with alkali metal aluminosilicates and other water-insoluble alkali metal compounds in the char particles to produce alkali metal constituents which dissolve in the water to form an aqueous solution. The resultant solution is recycled to the reaction zone where the alkali metal constituents are reused as at least a portion of the alkali metal-containing catalyst. Although this process permits additional recovery of alkali metal constituents, it normally requires an operating pressure above atmospheric and an operating temperature above at least 250° F., normally at about 300° F. or above. These relatively severe operating conditions result in increased operating costs.

SUMMARY OF THE INVENTION

The present invention provides an improved process for the recovery of alkali metal constituents from mixtures of char, ash and alkali metal residues produced during coal gasification and other conversion processes carried out in the presence of an alkali metal-containing catalyst. In accordance with the invention, it has now been found that increased amounts of alkali metal constituents can be effectively recovered from particles containing alkali metal residues produced in the reaction zone of a coal gasification or related high temperature conversion process by contacting or washing the particles with an aqueous solution containing calcium or magnesium ions in a alkali metal recovery zone under relatively mild operating conditions whereby the calcium or magnesium ions displace alkali metal ions held by ion exchange sites in the particles thereby liberating the alkali metal ions and producing an aqueous effluent containing water-soluble alkali metal constituents. These alkali metal constituents are then used in the conversion process as at least a portion of the alkali metal constituents which comprise the alkali metal-containing catalyst. Preferably, such use is achieved by recycling the aqueous effluent containing the alkali metal constituents from the washing or leaching step to the conversion process. If desired, however, the alkali metal constituents may first be recovered from the effluent and then used in the conversion process.

In general, the ion exchange that occurs during the washing or leaching step and results in the increased recovery of alkali metal constituents will take place under relatively mild operating conditions. Thus, the particles containing the alkali metal residues will normally be contacted with the calcium or magnesium-containing aqueous solution at about atmospheric pressure and at a relatively low temperature, preferably a temperature below about 249° F.

The invention is based in part upon laboratory studies which indicate that when char produced from the fluid bed gasification of a coal impregnated with an alkali metal carbonate is serially washed with portions of a saturated calcium hydroxide solution, the resulting aqueous solution will contain significantly more potassium than if it was serially washed with water alone. Thus, the process of this invention makes it possible to obtain a significant increase in the amount of alkali metal constituents recoverable by water washing while at the same time maintaining relatively mild temperatures and pressures during the washing step. This in turn results in a substantial decrease in the amount of makeup alkali metal compounds necessary without substantially increasing investment and operating costs. As a result the invention makes possible substantial savings in gasification and other conversion operations carried out in the presence of alkali metal-containing catalysts and permits the generation of product gases and/or liquids at significantly lower cost than would otherwise be the case.

DESCRIPTION OF THE PREFERRED EMBODIMENTS

Figure 1:
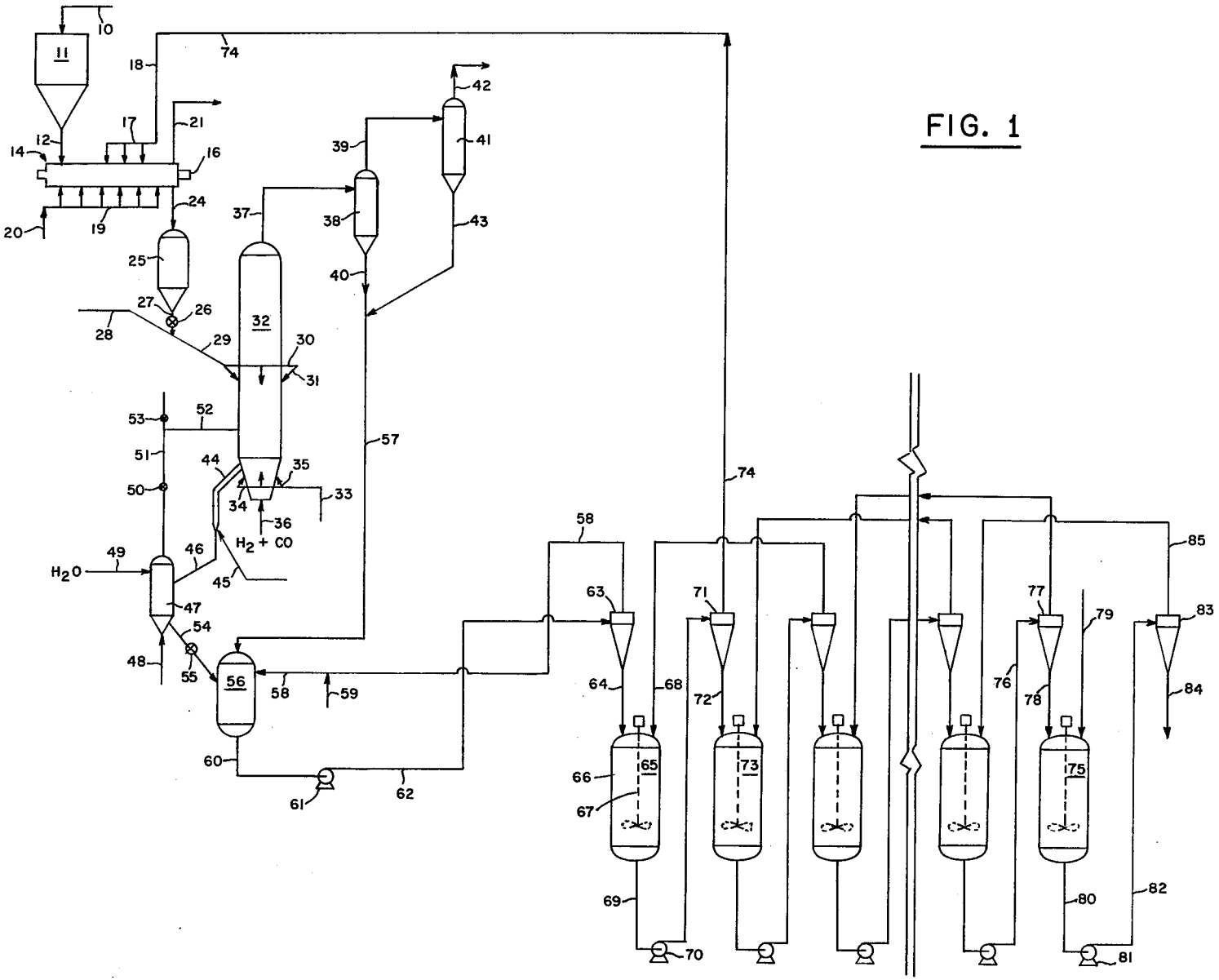
FIG. 1 in the drawing is a schematic flow diagram of a catalytic coal gasification process in which alkali metal constituents of the catalyst are recovered and reused in the process.

The process depicted in FIG. 1 is one for the production of methane by the gasification of a bituminous coal, subbituminous coal, lignite or similar carbonaceous solids with steam at high temperature in the presence of a carbon-alkali metal catalyst prepared by impregnating the feed solids with a solution of an alkali metal compound or a mixture of such compounds and thereafter heating the impregnated material to a temperature sufficient to produce an interaction between the alkali metal and the carbon present. It will be understood that the alkali metal recovery system utilized is not restricted to this particular gasification process and that it can be employed in conjunction with any of a variety of other conversion processes in which alkali metal compounds or carbon-alkali metal catalysts are used to promote the reaction of steam, hydrogen, oxygen or the like with carbonaceous feed materials to produce a char, coke or similar solid product containing alkali metal residues from which alkali metal compounds are recovered for reuse as the catalyst or a constituent of the catalyst. It can be employed, for example, for the recovery of alkali metal compounds from various processes for the gasification of coal, petroleum coke, lignite, organic waste materials and similar solids feed streams which produce spent carbonaceous solids. Other conversion processes with which it may be used include operations for the carbonization of coal and similar feed solids, for the liquefaction of coal and related carbonaceous materials, for the retorting of oil shale, for the partial combustion of carbonaceous feed materials, and the like. Such processes have been disclosed in the literature and will be familiar to those skilled in the art.

In the process depicted in FIG. 1, a solid carbonaceous feed material such as bituminous coal, subbituminous coal, lignite or the like that has been crushed to a particle size of about 8 mesh or smaller on the U.S. Sieve Series Scale is passed into line 10 from a feed preparation plant or storage facility that is not shown in the drawing. The solids introduced into line 10 are fed into a hopper or similar vessel 11 from which they are passed through line 12 into feed preparation zone 14. This zone contains a screw conveyor or similar device, not shown in the drawing, that is powered by a motor 16, a series of spray nozzles or similar devices 17 for the spraying of alkali metal-containing solution supplied through line 18 onto the solids as they are moved through the preparation zone by the conveyor, and a similar set of nozzles or the like 19 for the introduction of steam into the preparation zone. The steam, supplied through line 20, serves to heat the impregnated solids and drive off the moisture. Steam is withdrawn from the feed preparation zone through line 21 and passed to a condenser, not shown, from which it may be recovered for use as makeup water or the like. The alkali metal-containing solution is recycled through line 74 from the alkali metal recovery section of the process, which is described in detail hereafter.

It is preferred that sufficient alkali metal-containing solution be introduced into feed preparation zone 14 to provide from about 1 to about 50 weight percent of the alkali metal compound or mixture of such compounds on the coal or other carbonaceous solids. From about 1 to about 15 weight percent is generally adequate. The dried impregnated solid particles prepared in zone 14 are withdrawn through line 24 and passed to a closed hopper or similar vessel 25. From here they are discharged through a star wheel feeder or equivalent device 26 in line 27 at an elevated pressure sufficient to permit their entrainment into a stream of high pressure steam, recycle product gas, or similar inert gas or other carrier gas introduced into line 29 via line 28. The carrier gas and entrained solids are passed through line 29 into manifold 30 and fed from the manifold through feedlines 31 and nozzles, not shown in the drawing, into gasifier 32. In lieu of or in addition to hopper 25 and star wheel feeder 26, the feed system may employ parallel lock hoppers, pressurized hoppers, aerated standpipes operated in series, or other apparatus to raise the input feed solids stream to the required pressure level.

It is generally preferred to operate the gasifier 32 at a pressure between about 100 and about 2000 psig. The carrier gas and entrained solids will normally be introduced at a pressure somewhat in excess of the gasifier operating pressure. The carrier gas may be preheated to a temperature in excess of about 300° F. but below the initial softening point of the coal or other feed material employed. Feed particles may be suspended in the carrier gas in a concentration between about 0.2 and about 5.0 pounds of solid feed material per pound of carrier gas. The optimum ratio for a particular system will depend in part upon feed particle size and density, the molecular weight of the gas employed, the temperature of the solid feed material and input gas stream, the amount of alkali metal compound employed and other factors. In general, ratios between about 0.5 and about 4.0 pounds of solid feed material per pound of carrier gas are preferred.

Gasifier 32 comprises a refractory lined vessel containing a fluidized bed of carbonaceous solids extending upward within the vessel above an internal grid or similar distribution device not shown in the drawing. The bed is maintained in the fluidized state by means of steam introduced through line 33, manifold 34 and peripherally spaced injection lines and nozzles 35 and by means of recycle hydrogen and carbon monoxide introduced through bottom inlet line 36. The particular injection system shown in the drawing is not critical and hence other methods for injecting the steam and recycle hydrogen and carbon monoxide may be employed.

The injected steam reacts with carbon in the feed material in the fluidized bed in gasifier 32 at a temperature within the range between about 800° F. and about 1600° F. and at a pressure between about 100 and about 2000 psig. Due to the equilibrium conditions existing in the bed as the result of the presence of the carbon-alkali metal catalyst and the recycle hydrogen and carbon monoxide injected near the lower end of the bed, the reaction products will normally consist essentially of methane and carbon dioxide. Competing reactions which in the absence of the catalyst and the recycle gases would ordinarily tend to produce additional hydrogen and carbon dioxide in the raw product gas thus formed will preferably range from about 1 to about 1.4 moles per mole, depending upon the amount of hydrogen and oxygen in the feed coal or other carbonaceous solids. The coal employed may be considered as an oxygenated hydrocarbon for purposes of describing the reaction. Wyodak coal, for example, may be considered as having the approximate formula $CH_{0.84}O_{0.20}$, based on the ultimate analysis of moisture and ash-free coal and neglecting nitrogen and sulfur. The reaction of this coal with steam to produce methane and carbon dioxide is as follows:

$$1.24H_2O(g)+1.8CH_{0.84}O_{0.20}\rightarrow 0.8CO_2+CH_4$$

Under the same gasification conditions, coals of higher oxygen content will normally produce lower methane to carbon dioxide ratios and those of lower oxygen content will yield higher methane to carbon dioxide ratios.

The gas leaving the fluidized bed in gasifier 32 passes through the upper section of the gasifier, which serves as a disengagement zone where particles too heavy to be entrained by the gas leaving the vessel are returned to the bed. If desired, this disengagement zone may include one or more cyclone separators or the like for removing relatively large particles from the gas. The gas withdrawn from the upper part of the gasifier through line 37 will normally contain methane and carbon dioxide produced by reaction of the steam with carbon, hydrogen and carbon monoxide introduced into the gasifier as recycle gas, unreacted steam, hydrogen sulfide, ammonia and other contaminants formed from the sulfur and nitrogen contained in the feed material, and entrained fines. This gas is introduced into cyclone separator or similar device 38 for removal of the larger fines. The overhead gas then passes through line 39 into a second separator 41 where smaller particles are removed. The gas from which the solids have been separated is taken overhead from separator 41 through line 42 and the fines are discharged downward through dip legs 40 and 43. These fines may be returned to the gasifier or passed to the alkali metal recovery section of the process as discussed hereafter.

After entrained solids have been separated from the raw product gases described above, the gas stream may be passed through suitable heat exchange equipment for the recovery of heat and then processed for the removal of acid gases. Once this has been accomplished, the remaining gas, consisting primarily of methane, hydrogen and carbon monoxide, may be cryogenically separated into a product methane stream and a recycle stream of hydrogen and carbon monoxide, which is returned to the gasifier through line 36. Conventional gas processing equipment can be used. Since a detailed description of this downstream gas processing portion of the process is not necessary for an understanding of the invention, it has been omitted.

The fluidized bed in gasifier 32 is comprised of char particles formed as the solid carbonaceous feed material undergoes gasification. The composition of the char particles will depend upon the amount of mineral matter present in the carbonaceous material fed to the gasifier, the amount of the alkali metal compound or mixture of such compound impregnated into the feed material, and the degree of gasification that the char particles undergo while in the fluidized bed. The lighter char particles, which will have a relatively high content of carbonaceous material, will tend to remain in the upper portion of the fluidized bed. The heavier char particles, which will contain a relatively small amount of carbonaceous material and a relatively large amount of ash and alkali metal residues, will tend to migrate toward the bottom of the fluidized bed. A portion of the heavier char particles are normally withdrawn from the bottom portion of the fluidized bed in order to eliminate ash and thereby prevent it from building up within the gasifier and other vessels in the system.

During the gasification process taking place in reactor 32, alkali metal constituents of the gasification catalyst react with mineral constituents of the coal and other carbonaceous solids to form alkali metal residues containing water-soluble alkali metal compounds such as carbonates, sulfides and the like and water-insoluble compounds such as alkali metal alumino-silicates, alkali metal iron sulfides and similar compounds. To improve the economics of the catalytic gasification process described above and other catalytic conversion processes where alkali metal residues are formed and withdrawn with char and ash from the gasifier or reaction zone and alkali metal constituents are subsequently recovered, it has been proposed to convert the water-insoluble compounds in the alkali metal residues to water-soluble compounds by treating the char or other particles produced during the conversion process with a calcium or magnesium-containing compound at relatively severe operating conditions, pressures above atmospheric and temperatures above 250° F., in the presence of liquid water, thereby increasing the amount of water-soluble alkali metal constituents that can be recovered. It has now surprisingly been found that increased recovery of water-soluble alkali metal constituents can be obtained simply by washing or leaching the particles with an aqueous solution of calcium or magnesium ions at relatively mild conditions, normally at about atmospheric pressure and a temperature below about 249° F. The observed increase in recovery is apparently due to an ion exchange phenomenon. The calcium or magnesium ions displace alkali metal ions held by ion exchange sites in the particles thereby freeing the alkali metal ions and allowing them to enter the aqueous solution. Evidently a substantial amount of the alkali metal constituents in the gasification catalyst is tied up in the particles at ion exchange sites and a substantial portion of these constituents are not recoverable by water washing alone.

Referring again to FIG. 1, char particles containing carbonaceous material, ash and alkali metal residues are continuously withdrawn through line 44 from the bottom of the fluid bed in gasifier 32. The particles flow downward through line 44 countercurrent to a stream of steam or other elutriating gas introduced through line 45. Here a preliminary separation of solids based on differences in size and density takes place. The lighter particles having a relatively large amount of carbonaceous material tend to be returned to the gasifier and the heavier particles having a relatively high content of ash and alkali metal residues continue downward through line 46 into fluidized bed withdrawal zone 47.

The particles in vessel 47 are maintained in the fluidized state by means of steam, nitrogen or other inert gas introduced into the bottom of the withdrawal zone through line 48. The hot char particles in the fluidized bed in vessel 47 will normally be cooled to a temperature below about 200° F. by the introduction of water into the upper part of the vessel through line 49. It is preferred to regulate the rate at which the solids are withdrawn from the gasifier by controlling the pressure in vessel 47. This can be done by using control valve 50 to throttle the gas taken overhead through line 51, thus avoiding the necessity for passing high temperature solids through a slide valve or similar device. The gases from line 51 may be returned to the gasifier through line 52 or vented through valve 53. The solid particles in vessel 47 are now ready for treatment to recover alkali metal constituents.

The solid particles in vessel 47 are passed through line 54 containing pressure letdown valve 55 into slurry tank 56. Here the particles are combined with char fines recovered from the raw product gas through dip legs 40 and 43 and line 57 and the resulting mixture is slurried with water or an aqueous solution containing water-soluble alkali metal constituents injected into the slurry tank through line 58. Water may be injected into line 58 through line 59 and passed into slurry tank 56. The solution injected into tank 56 will normally consist of an aqueous solution containing alkali metal constituents produced by withdrawing the slurry formed in tank 56 through line 60 and passing it by means of pump 61 through line 62 to hydroclone, centrifuge, filter or similar liquid-solids separation device 63 where a large portion of the char and fines are removed from the liquid, which is recovered overhead of the separation device and recycled to the slurry tank through line 58. During the slurrying process which takes place in the tank, a portion of the water-soluble constituents present in the alkali metal residues passed into the slurry tank with the char will dissolve in the water thereby further enriching the solution in alkali metal constituents.

The particles removed from separation device 63 will contain water-insoluble alkali metal constituents, ion exchanged alkali metal constituents, water-soluble alkali metal constituents that did not pass into solution during slurrying in tank 56 and entrained liquid containing water-soluble constituents. The water-soluble alkali metal constituents remaining in the particles and the ion exchanged alkali metal constituents are recovered by passing the solids through a multistage countercurrent aqueous extraction unit which includes a plurality of tanks or vats, classifiers, screw-fed contacters, thickeners, continuous centrifuges or the like. The number of actual stages employed in the extraction system will depend to a large extent upon the composition of the solids fed to the system and the particular contacting conditions utilized. Each stage in the particular system shown in the drawing includes a closed vat or tank containing a stirrer, means for countercurrent circulation of liquids and solids from one tank to another, and a hydroclone, filter, centrifuge or similar liquids-solids separation device.

The solids removed from the slurry fed to separation device 63 are passed through line 64 into the final stage 65 of the multistage liquid-solids extraction train. This stage comprises a mixing tank 66 which contains a stirrer 67. In the mixing tank the solids are slurried with an aqueous solution containing a high concentration of alkali metal constituents and calcium or magnesium ions introduced into the tank through line 68 and the resultant slurry is agitated by the stirrer. The temperature in the tank is normally maintained at a value near the boiling point of the aqueous medium, preferably below about 249° F., while the tank is held near atmospheric pressure. Water-soluble and ion exchanged alkali metal constituents present in the solid particles are in part extracted by the liquid in contact with the particles.

The slurry which is formed in stage 65 is withdrawn from the bottom of tank 66 through line 69 and circulated by means of pump 70 to hydroclone, centrifuge, filter or similar liquid-solids separation device 71 where the solids are removed from the liquid. These solid particles, from which a portion of the water-soluble and ion exchanged alkali metal constituents have been extracted, are discharged through line 72 into stage 73 of the apparatus. The liquid separated from the solids in hydroclone 71, richer in alkali metal constituents and leaner in calcium or magnesium ions than the liquid in stage 73, is withdrawn from the hydroclone through line 74. This solution will normally be recycled through lines 74 and 18 to feed preparation zone 14. Here, the coal or similar carbonaceous feed material is impregnated with the alkali metal constituents in the aqueous solution. If the concentration of the alkali metal constituents in the recycle stream is undesirably low, the solution may be concentrated by removing excess water before it is returned to the feed preparation zone. The solution may be treated with carbon dioxide prior to recycle in order to convert the alkali metal constituents into alkali metal carbonates and bicarbonates. In lieu of recycling the solution in line 74 to the feed preparation zone, alkali metal constituents can be separated from the solution by evaporation and crystallization, precipitation or other methods and added to the feed material in solid form.

Stage 73 and the other intermediate stages of the recovery train are generally similar to stage 65. In each of these stages, solids separated from a liquid stream, which has a relatively high concentration of alkali metal constituents and a relatively low concentration of calcium or magnesium ions, in the hydroclone or other liquid-solids separator associated with that stage are discharged into a solution less concentrated in alkali metal constituents and more concentrated in calcium or magnesium ions and the solution from the hydroclone or similar device is passed downstream for contact with solids having a higher content of water-soluble and ion exchanged alkali metal constituents. Slurry from each stage is pumped to the hydroclone in the adjacent upstream stage for separation into liquid and solid components. In the initial stage 75 of the train, incoming slurry from the second stage flows through line 76 to hydroclone or the like 77, from which the solids are discharged through line 78 into a concentrated solution of calcium or magnesium ions introduced into the stage through line 79.

The concentrated solution of calcium or magnesium ions introduced through line 79 into stage 75 is produced by dissolving a solid calcium or magnesium compound in water in a mixing tank, which is not shown in the drawing. The calcium or magnesium compound used to produce the concentrated solution may be any inorganic or organic calcium or magnesium-containing compound that ionizes or dissociates in water to yield calcium or magnesium ions. The calcium-containing compound may, for example, be calcium oxide, calcium hydroxide, calcium acetate, calcium oxalate, or the like. Similarly, the magnesium-containing compound may be magnesium oxide, magnesium hydroxide, magnesium acetate, magnesium oxalate, or the like. The actual magnesium or calcium-containing compound used will depend primarily upon its availability, cost and degree of solubility in water. The amount of the calcium or magnesium compound needed will depend in part on the amount of alkali metal constituents that are held at ion exchange sites in the char, ash, and alkali metal residues. If desired, a mixture of two or more calcium or magnesium-containing compounds may be used in lieu of a single compound.

The slurry formed in initial stage 75 by the mixing of the calcium or magnesium-containing solution with solids from which most of the water-soluble and ion exchanged alkali metal constituents have been extracted results in a slurry of solid particles in a solution containing a low concentration of alkali metal constituents. The slurry is withdrawn through line 80 by means of pump 81 and passed through line 82 to hydroclone or similar device 83. The solids withdrawn from the hydroclone through line 84 will normally contain, among other substances, small amounts of carbonaceous material, ash, water-insoluble alkali metal constituents and a small amount of water-soluble and ion exchanged alkali metal constituents. These solids may be further treated in such a fashion as to recover the water-insoluble alkali metal constituents or they may be disposed of by landfill, used for construction purposes, or employed in other applications. The solution recovered from hydroclone 83, which has a low concentration of alkali metal constituents and a high concentration of calcium or magnesium ions, is passed through line 85 to the second stage of the recovery train.

In the embodiment of the invention shown in FIG. 1 and described above, char particles containing alkali metal residues are treated for the recovery of water-soluble and ion exchanged alkali metal constituents by subjecting the particles to washing with an aqueous solution containing calcium or magnesium ions in a countercurrent multistage water extraction system. It will be understood that the process of the invention is not limited to this particular alkali metal recovery system and can be used in conjunction with any type of alkali metal recovery system in which particles containing alkali metal residues are leached with a calcium or magnesium-containing solution at mild conditions for the recovery of alkali metal constituents.

The nature and objects of the invention are further illustrated by the results of laboratory tests which indicate that the amount of alkali metal compounds that can be recovered from a char produced during the catalytic gasification of a coal impregnated with an alkali metal compound by washing the char with an aqueous calcium-containing solution is significantly greater than the amount that can be recovered by washing the char with pure water.

Illinois No. 6 coal impregnated with potassium carbonate was steam-gasified in the presence of added hydrogen and carbon monoxide under conditions such that about 80 percent of the carbon in the coal was converted into gases. A portion of the char was serially washed with a fresh saturated solution of calcium hydroxide in a solution-to-char weight ratio of about 3:1. Each wash was conducted for a period of one hour near the bubble point of the solution and the resultant liquid was recovered by vacuum filtration and analyzed for potassium. Prior to washing the char it was analyzed for total potassium. The same procedure was repeated for another sample of the same char using distilled water as the leaching agent. The results of these tests are set forth in FIG. 2.

Figure 2:
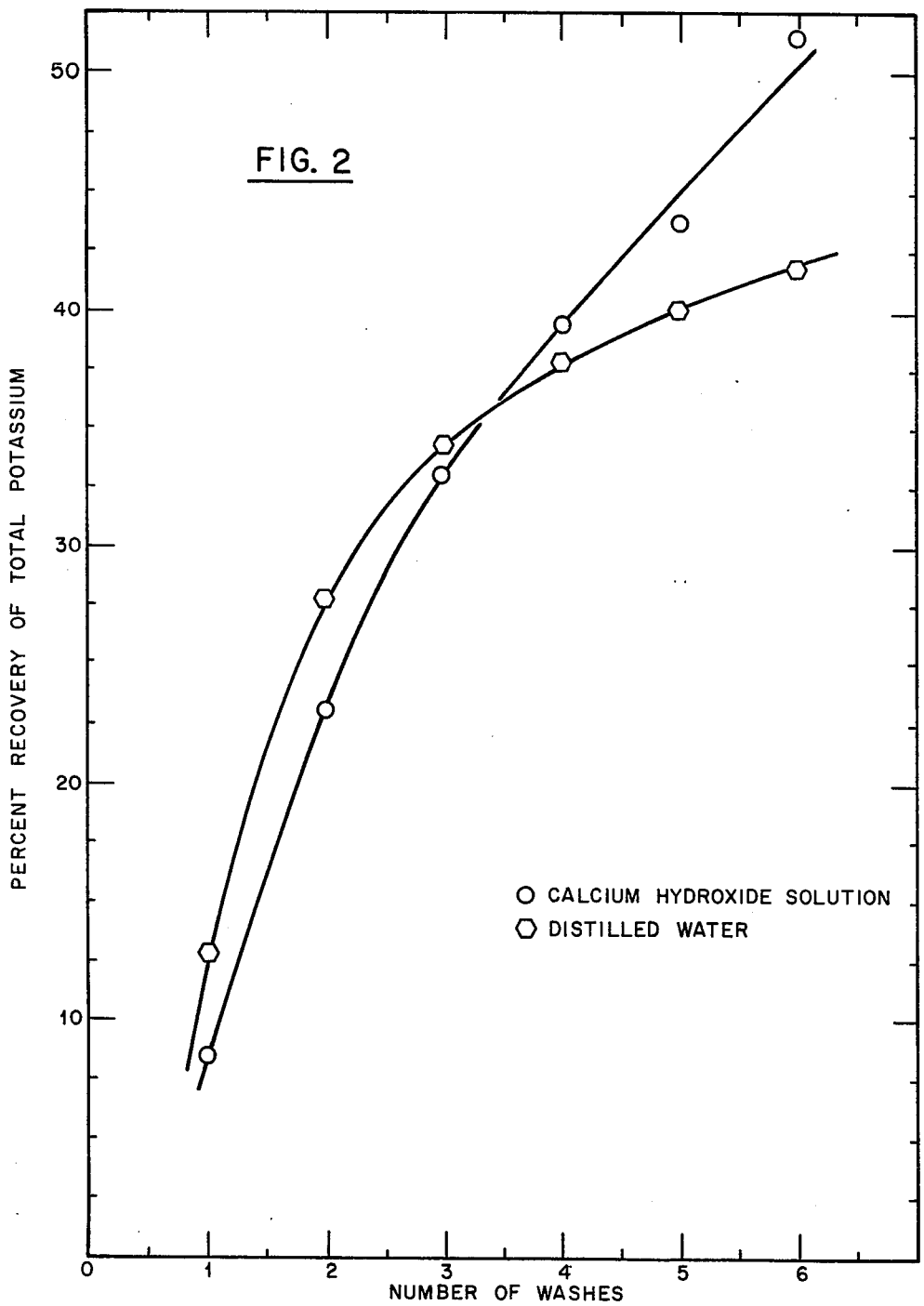
FIG. 2 is a plot comparing the amount of potassium recovered by water washing a char produced by the fluid bed gasification of a coal impregnated with potassium carbonate to that recovered by washing the char with an aqueous solution of calcium hydroxide.

It can be seen from FIG. 2 that after the fourth wash the amount of potassium recoverable by washing with the calcium hydroxide solution continues to increase at a rapid rate while the amount recoverable by leaching with distilled water begins to level out. After six washes, potassium recovery, based on the total potassium originally present in the char, with the calcium hydroxide wash was about 10 percent greater than the recovery obtained using distilled water. The data set forth in FIG. 2 tend to indicate that a portion of the alkali metal constituents in the char are held at ion exchange sites and are not recoverable by water washing alone but are displaced by the calcium ions in the calcium hydroxide solution.

It will be apparent from the foregoing that the invention provides a process which makes it possible to recover increased amounts of alkali metal constituents from mixtures of alkali metal residues, ash, and char produced during catalytic gasification and similar high temperature conversion processes. As a result, the need for costly makeup alkali metal compounds is reduced, thereby lowering the overall cost of the conversion process.

I claim:

1. In a process for the conversion of a solid carbonaceous feed material in the presence of an alkali metal-containing catalyst into liquids and/or gases wherein particles containing alkali metal residues are produced, the improvement which comprises:

(a) contacting said particles containing said alkali metal residues with a sufficiently concentrated aqueous solution of a calcium or magnesium-containing compound at a temperature below about 249° F. whereby calcium or magnesium ions from said calcium or magnesium-containing compound displace alkali metal ions held by ion exchange sites in said particles thereby producing an aqueous effluent containing alkali metal constituents and wherein said temperature is sufficiently below about 249° F. to substantially prevent the conversion of water-insoluble alkali metal aluminosilicates and other water-insoluble alkali metal compounds in said particles into water-soluble alkali metal compounds; and (b) using said alkali metal constituents from said aqueous effluent produced in step (a) in said conversion process as at least a portion of the alkali metal constituents comprising said alkali metal-containing catalyst.

2. A process as defined in claim 1 wherein said conversion process comprises gasification.

3. A process as defined in claim 1 wherein said conversion process comprises liquefaction.

4. A process as defined in claim 1 wherein at least a portion of said alkali metal-containing catalyst comprises potassium carbonate.

5. A process as defined in claim 1 wherein said particles containing said alkali metal residues are contacted with a solution of calcium hydroxide.

6. A process as defined in claim 1 wherein said aqueous effluent is recycled to said conversion process where said alkali metal constituents are used as at least a portion of said alkali metal constituents comprising said alkali metal-containing catalyst.

7. A process as defined in claim 1 wherein said particles containing said alkali metal residues are contacted with said aqueous solution of said calcium or magnesium-containing compound in a multistage countercurrent extraction system.

8. A process as defined in claim 1 wherein said carbonaceous feed material comprises coal.

9. A process as defined in claim 1 wherein said alkali metal-containing catalyst comprises a carbon-alkali metal catalyst.

10. In a process for the production of a methane-containing gas wherein coal is gasified in the presence of a carbon-alkali metal catalyst and particles containing alkali metal residues are produced, the improvement which comprises:

(a) introducing said particles into the final stage of a countercurrent multistage leaching system having an initial stage and a final stage;

(b) introducing an aqueous solution of a calcium-containing compound into said initial stage of said leaching system said aqueous solution having a sufficient concentration of said calcium containing compound to remove the alkali metal constituents originally held by ion exchange sites in said particles;

(c) passing said particles and said aqueous solution in contact with each other countercurrently through said leaching system at a temperature sufficiently below about 249° F. to substantially prevent the conversion of water-insoluble alkali metal aluminosilicates and other water-insoluble alkali metal compounds in said particles into water-soluble alkali metal compounds;

(d) withdrawing particles substantially depleted of water-soluble alkali metal constituents and alkali metal constituents originally held by ion exchange sites in said particles from said initial stage of said system;

(e) withdrawing a solution enriched in water-soluble alkali metal constituents and alkali metal constituents originally held by ion exchange sites in said particles from said final stage of said system; and (f) recycling the solution from step (e) to said gasification process where said alkali metal constituents are used as at least a portion of said alkali metal constituents comprising said carbon-alkali metal catalyst.

11. A process as defined in claim 10 wherein said carbon-alkali metal catalyst comprises a carbon-potassium reaction product.

* * * * *